United States Patent [19]

Bridge

[11] 4,103,600

[45] Aug. 1, 1978

[54] CHIMNEY CAP

[76] Inventor: John Gardiner Bridge, R.D. 1, Chestnut Ridge, Glens Falls, N.Y. 12801

[21] Appl. No.: 798,249

[22] Filed: May 18, 1977

[51] Int. Cl.[2] ..... F23L 17/02

[52] U.S. Cl. ..... 98/66 R; 98/78

[58] Field of Search ..... 98/61, 66 R, 78

[56] References Cited

U.S. PATENT DOCUMENTS

| | | | |
|---|---|---|---|
| 538,366 | 4/1895 | Cooper | 98/66 R |
| 826,345 | 7/1906 | Miller et al. | 98/66 R |
| 1,669,722 | 5/1928 | Miller | 98/66 R |
| 2,191,948 | 2/1940 | Artis | 98/78 |
| 2,676,529 | 4/1954 | Artis | 98/66 R |
| 2,830,526 | 4/1958 | Breidert | 98/81 |
| 3,369,475 | 2/1968 | Artis et al. | 98/66 R |

OTHER PUBLICATIONS

Front page of Catalogue of Artis Co., Inc., (Boise, Idaho-1976).

Page 27 of Leigh Products, Inc., Catalogue (Coopersville, Mich.).

Price sheet of Steinen of Carolina, Inc., (Kinston, N. Car.).

*Primary Examiner*—Edgar W. Geoghegan

*Attorney, Agent, or Firm*—Brumbaugh, Graves, Donohue & Raymond

[57] ABSTRACT

A chimney cap for diverting rain and downdrafts from a chimney while providing minimal restriction to the upward escape of chimney gases includes a base, for attachment to the chimney, and two arch-like sheet metal members attached to the base. The arches are of different heights and overlap one another over the center of the base to form a clearance therebetween for the escape of gases. The crowns of the arches are inclined in opposite directions and slope downward from the center of the cap to overlie opposite sides of the base.

3 Claims, 2 Drawing Figures

CHIMNEY CAP

BACKGROUND OF THE INVENTION

1. Field of the Invention

This invention relates to an improved inexpensive chimney cap which is designed to shield the chimney from rain and wind while allowing gases and smoke to freely escape.

2. The Prior Art

Various chimney caps have been designed over the years. Such prior designs typically employ horizontal members overlying the chimney outlet. Although those designs kept out wind and rain, they severely altered the direction of the exiting smoke and gas and thus interfered with the chimney's natural draft. In addition, chimney caps in the prior art have tended to be unduly complex in design, thereby increasing manufacturing and assembly costs. Since chimney caps are an item for which a consumer is not likely to spend much money, low manufacturing and assembly costs are an important feature in cap design.

U.S. Pat. No. 538,366 to Cooper was an early design for a chimney cap made from arched pieces of sheet-metal. It was designed to be mounted permanently on a chimney rather than on a removable base and it was made from a minimum of four parts. U.S. Pat. Nos. 2,191,948, 2,676,529 and 3,369,475, all issued to Artis, show an effort to reduce the number of parts used in constructing a chimney cap. Despite several design changes, the Artis cap, as illustrated in the U.S. Pat. No. 3,369,475 still required at least four pieces and its design, although arch-shaped, leads to abrupt changes in the upward movement of smoke and gases from the chimney.

The chimney cap described in this application overcomes both the problems of decreasing manufacturing and assembly costs and of reducing the degree of restriction of the smoke and gas coming from the chimney.

SUMMARY OF THE INVENTION

In accordance with the invention, the novel chimney cap includes an open base member and two arch-like members of sheet material. Each arch-like member has a central portion and two leg portions, with one arch being higher or larger than the other. The opposite legs of both arch-like members are attached in overlapping relation to the same opposite sides of the base such that the crowns of the members are inclined in opposite directions so as to slant downward from the center of the cap, where the two arch-like members overlap, towards and over opposite ones of the two remaining sides of the base. Clearances are provided between the overlapping central parts of the arch-like members, for minimal restriction to upward flow of chimney gases, and between the outer parts of the arches and the underlying base sides. To facilitate manufacture and installation of the cap, the base is preferably comprised of two identical halves which are fastened together at flanges formed at the ends of the respective halves.

DETAILED DESCRIPTION OF THE INVENTION

Figure 1:
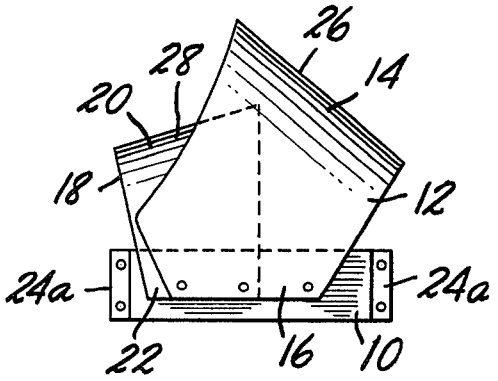
FIG. 1 is a side view of the chimney cap embodying the invention.
Figure 2:
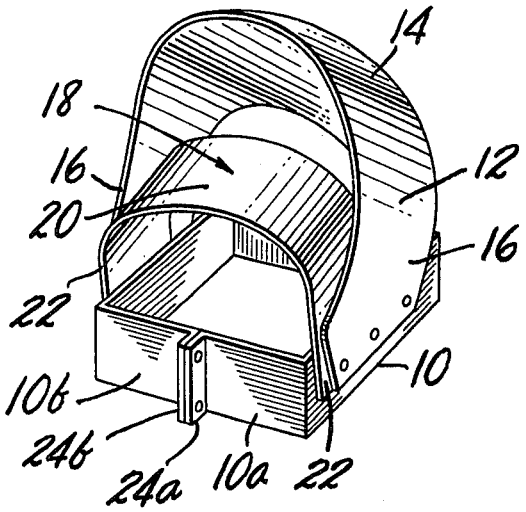
FIG. 2 is a perspective view of the chimney cap.

The improved chimney cap of the present invention is illustrated in FIGS. 1 and 2. The cap includes an open base 10 which is used to attach the cap to the chimney, a large sheet metal arch-like member 12 having a central curved portion 14 and two leg portions 16, and a smaller sheet metal arch-like member 18 having a curved portion 20 and two leg portions 22.

The base 10 is preferably made of two identical sheet metal pieces **10*a* and 10*b* which are joined together at flanges 24*a* and 24*b* formed at either end thereof. The flanges may be secured together in any suitable way, such as by rivets, bolts or the like. If desired, the base 10 may be formed as a single piece which is bent to bring the ends back on one another. In that event, only one pair of flanges 24*a* and 24*b*** would be required. Also, the base may be given any configuration (including round) suitable for connection to a chimney top, the square configuration shown in the drawing being for illustrative purposes only.

The arches 12 and 18 are attached at their leg portions 16 and 22, respectively, to the same opposite sides of the base. As shown in FIG. 1, the arches are so attached that the large arch 12 overlaps the small arch 18 near the center of the cap and at their respective leg portions 16 and 22, and such that the crowns 26 and 28 of the central curved portions 14 and 20, respectively, slant downward in opposite directions from the center of the cap toward the flanged sides of the base 10. Preferably, the arches 12 and 18 extend somewhat over the flanged sides for improved drainage. The clearance provided between the large arch 12 and the small arch 18 is variable, but should be sufficient to allow gas and smoke to exit freely from the chimney. This clearance may be changed as conditions require by changing the angle at which the arches 12 and 18 are attached to the base 10.

The arrangement whereby the arches 12 and 18 are overlapped but are also slanted toward the base ends and separated by a clearance at the center, allows the gases and smoke emanating from the chimney to rise with only minor restriction and change in flow direction, while at the same time preventing rain or debris from falling into the chimney. In addition, the arch-shaped design allows the wind blowing from the side of the cap, i.e., in the direction normal to the plane of FIG. 1, to be directed over the top of the cap. Wind blowing directly into the open ends of the cap, as shown in FIG. 2, will flow through the cap and out the other side, drawing the chimney smoke and gases with it.

While the invention has been particularly shown and described with reference to a preferred embodiment, it will be understood by those skilled in the art that various changes in form and details may be made therein without departing from the spirit and scope of the invention. For example, although the central portions of the arches shown in the drawing are curved, they may be flat, trapezoidal or any other suitable shape.

I claim:

1. A chimney cap for diverting rain and downdrafts with minimal restriction to the escape of gases from the chimney, comprising:

a generally horizontally disposed open base for attachment to a chimney; and two arch-like members of sheet material, each having a central portion and two opposite leg portions, one arch-like member being larger than the other, the opposite leg portions of both arch-like members being attached in overlapping relation to the same opposite sides of the base such that the crowns of said central portions are inclined to the horizontal in opposite directions so as to slant downward from the center of the cap towards opposite ones of the two remaining sides of the base, the larger arch-like member overlapping the smaller arch-like member near the center of the cap and defining a clearance therebetween for escape of chimney gases, the arch-like members also overlapping and defining clearances with said opposite ones of the remaining sides of the base.

2. The chimney cap of claim 1 wherein the base is constructed from two substantially identical halves of sheet material, each of said halves being formed at the ends thereof with flanges for attachment to the other half.

3. The chimney cap of claim 1 wherein the central portion is curved.

* * * * *